US005215206A

United States Patent [19]

Siblik

[11] Patent Number: 5,215,206

[45] Date of Patent: Jun. 1, 1993

[54] DRUM CLOSURE ASSEMBLY

[75] Inventor: Allen D. Siblik, Wadsworth, Ill.

[73] Assignee: Hallen Products, Ltd., Wadsworth, Ill.

[21] Appl. No.: 970,013

[22] Filed: Nov. 2, 1992

[51] Int. Cl.[5] ..... B65D 45/32

[52] U.S. Cl. ..... 220/320; 292/256.67; 411/188; 411/959

[58] Field of Search ..... 220/319, 320; 215/275; 292/256.6, 256.67; 411/132, 133, 134, 135, 149, 187, 188, 957, 959

[56] References Cited

U.S. PATENT DOCUMENTS

| | | | |
|---|---|---|---|
| 1,969,120 | 8/1934 | Coakley | 220/320 X |
| 2,226,396 | 12/1940 | Wackman . | |
| 2,603,382 | 7/1952 | Kojan . | |
| 2,633,616 | 4/1953 | Kohout . | |
| 3,022,103 | 2/1962 | Klygis | 292/256.67 |
| 3,417,802 | 12/1968 | Oldenkott | 411/959 X |
| 3,803,667 | 4/1974 | Rose | 411/959 X |
| 3,907,349 | 9/1975 | Kane . | |
| 4,034,788 | 7/1977 | Melone | 411/134 |
| 4,134,609 | 1/1979 | Santoni . | |
| 4,200,316 | 4/1980 | Kennedy . | |
| 4,792,056 | 12/1988 | Tiernan | 220/320 |
| 4,957,317 | 9/1990 | Jakubas . | |
| 4,982,864 | 1/1991 | Kusta | 220/320 |

*Primary Examiner*—Allan N. Shoap
*Assistant Examiner*—Nova Stucker
*Attorney, Agent, or Firm*—McCaleb, Lucas & Brugman

[57] ABSTRACT

A closure ring assembly for securing a cover in sealed relation over the open top of a storage drum container in which a split ring is closed by tightening a headed tie bolt between a pair of laterally spaced lugs fixed to the ring on opposite of the split therein; the bolt freely passing through one of the lugs and threadingly engaging the other so that upon tightening the bolt the ring is contracted with the one non-threaded lug having outwardly extending teeth for engaging the bolt head to lock the same in tightened position.

7 Claims, 1 Drawing Sheet

DRUM CLOSURE ASSEMBLY

FIELD OF INVENTION

This invention relates to closure assemblies for securing lids or covers over the open heads of generally cylindrical storage drums used for storing and transporting bulk materials and more particularly to improvements in locking lugs or clamp members fixed to split metal closure rings used for securing the drum lids in operating position.

BACKGROUND OF THE INVENTION

Storage drums of the type to which this invention pertains are commonly employed by industry because they are relatively easy to clean and are normally reusable. In general the drums have a semi-cylindrical bead rim about their upper ends and the lids have a mating peripheral lip which fits over the drum bead and an intervening gasket seal. An annular split metal closure ring is posed over the lid's lip and drum bead and then compressed to bring the ends of the ring in near abutting relation to secure the lid in place and compress the gasket. This effects a seal between the drum and lid. Typically, a pair of locking lugs or clamp members are welded to the ring one on either side of the split therein so that they extend outwardly of the ring. The mounted lugs or clamps have coaxially aligned openings for passage of a tie bolt therethrough. In some instances a nut is associated with one of the lugs to engage the outer threaded end of the tie bolt and in other instances the opening in that lug is internally threaded to engage the bolt threads. In either instance preferably the opening in the other lug is unthreaded for free passage of the tie bolt. Appropriate threading movement of the bolt serves to tighten the bolt connection between the lugs and accordingly compress the ring to effect sealed connection between the lid and drum.

One of the major problems encountered with such described assembly is that all too frequently the tie bolt tends to back off or loosen during transportation and handling of the drum which leads to undesirable loosening of the ring and disruption of the sealed relation between lid and drum.

The present invention is addressed to means for alleviating this problem.

SUMMARY OF THE INVENTION

In brief, this invention is directed to an improved drum closure assembly of the type employing an annular split metal ring having a pair of outwardly projecting locking lugs fixed thereto on opposite sides of the split ring's adjacent opposing ends. The two lugs are assembled on the ring to coaxially align central openings therein for passage of a tie bolt along an axis paralleling the ring. Tightening of the bolt draws the ends of the ring together to secure the same about the head of the drum. In its preferred form one of the lugs has an enlarged transverse opening for the free passage of a headed tie bolt therethrough while the opening in the other lug is threaded to engage the threaded outer end of the bolt. Formed about the circumference of the opening in the one unthreaded lug so as to project outwardly of at least one side face thereof are a series of protruding disruptions or sharp teeth designed to underengage the bolt head in a manner permitting bolt rotation in one direction (tightening) while opposing reverse rotation thereof. Thus when the tie bolt is tightened between the two lugs to close the split ring, loosening or backing off of the bolt with consequent unwanted expansion of the ring is substantially prevented. Preferably the opposite sides or faces of the unthreaded lug are provided with such locking protrusions, aligned in directions so that the lug may be used with bolts installed from either the right hand or left hand side of the assembly, as selected.

It is a primary object of this invention to provide an improved split-ring closure assembly for use with storage drums which comprises tie bolt receptive locking lugs structured to hold the tightened tie bolt in ring compressing position.

It is another important object of this invention is to provide an improved storage drum closure ring assembly which is operable to prevent disruption of the sealed relation between the locked drum cover and drum.

Still another important object of this invention is to provide an improved, simple and economical ring closure assembly having automatic bolt-locking features.

Another important object of this invention is to provide an improved locking lug for use with a tie bolt in a drum ring closure assembly which is capable of rotatably locking both left and right hand installed tie bolts.

A still further object of this invention is to provide improved locking means for use in a closure ring assembly which comprises internally threaded and nonthreaded bolt receptive lugs fixed to opposite ends of a split closure ring for securing the ring to the lid and upper end of a storage drum.

Still an additional object of this invention is to provide a closure ring assembly comprising tie bolt receptive lugs wherein a unthreaded one of the lugs is provided with facial locking projections capable of positively interferingly engaging the head of the tie bolt upon reverse rotation thereof.

Having described this invention the above and further objects, features and advantages thereof will be recognized from the following description of a preferred embodiment thereof illustrated in the accompanying drawings and representing the best mode presently contemplated for enabling those skilled in the art to practice this invention.

IN THE DRAWINGS

DESCRIPTION OF THE PREFERRED EMBODIMENT

Figure 1:
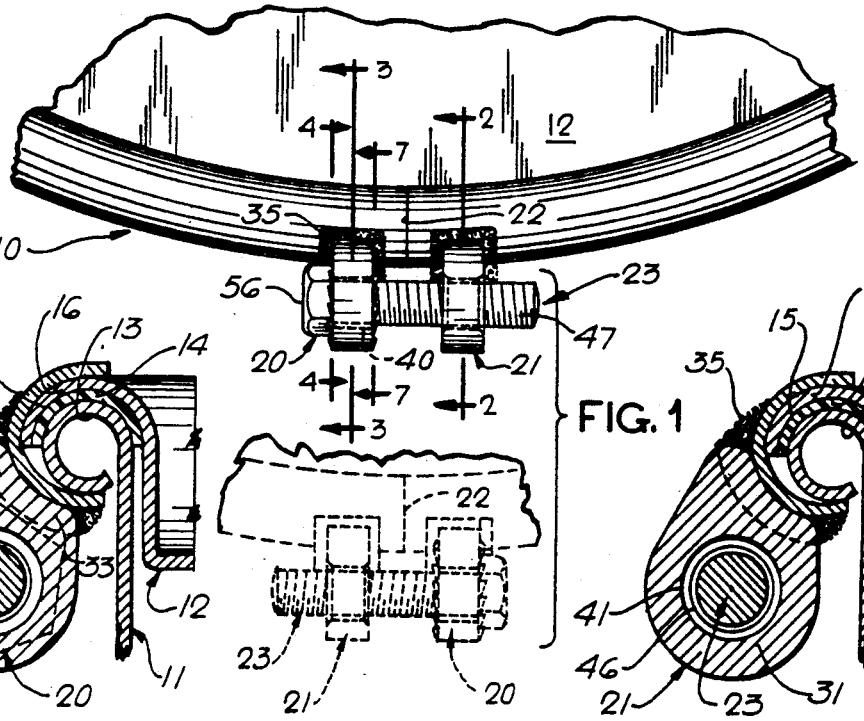
FIG. 1 is a partial top plan view of a storage drum and closure assembly embodying the present invention and showing in phantom an alternative assembly thereof.
Figure 3:
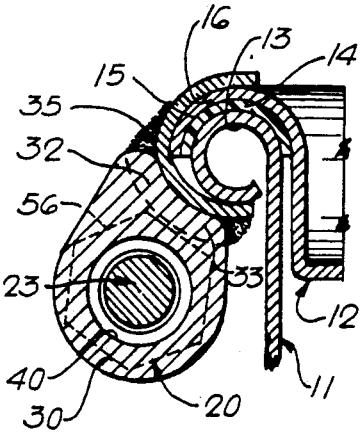
FIG. 3 is a cross sectional view, similar to FIG. 2, taken substantially along vantage line 3—3 of FIG. 1 and looking in the direction of the arrows thereon.
Figure 2:
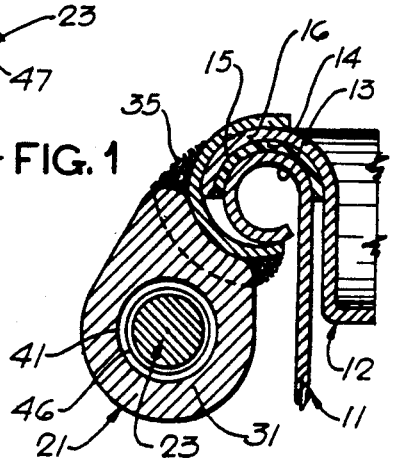
FIG. 2 is an enlarged cross sectional view taken substantially along vantage line 2—2 of FIG. 1 and looking in the direction of the arrows therein.

With initial reference to FIGS. 1-3 of the drawings, it will be recognized that a closure ring assembly, indicated generally at 10, is mountable over the open upper end of a conventional storage drum 11 which is adapted to be closed over by a cover or lid 12. The drum 11 has a rolled annular peripheral bead rim 13 formed about its upper end and a compressible gasket 14 is normally fitted between the upper side of rim 13 and the under or concave side 15 of an annular rolled lip 16 formed about the periphery of cover 12 (see FIGS. 2 and 3). Assembly 10 serves to lock the cover 12 to the drum's bead rim while compressing the sealing gasket between that rim and the cover's lip 16.

The improved closure ring assembly 10 hereof comprises an annular split metal ring 18 of arcuate generally semi-circular transverse cross section. A pair of laterally spaced rigid locking lugs 20, 21 are fixed to the ring in positions of spaced parallelism on opposite sides of the opposing ends thereof which are separated by the ring split indicated generally at 22 in FIG. 1. The two lugs extend outwardly of the ring and preferably depend angularly therefrom in the manner illustrated in FIGS. 2 and 3.

Closure of the ring is effected by means of a hex headed tie-bolt 23 which extends between and cross connects the two lugs.

Lugs 20, 21 preferably are made as integral forged metal structures although other methods of manufacture may be resorted to. For example, fabricated lugs made by stamping and forming sheet metal are described in U.S. Pat. No. 4,200,316 issued Apr. 29, 1980. Such fabricated lugs are especially adapted to light load applications. In any event, the herein illustrated lugs 20, 21 have like generally cylindrical body portions 30, 31, respectively. Spaced weld ears 32, 33 are integral with the main body portion of each of the lugs and protrude tangentially from the upper end thereof. A concave surface 34 extends between each pair of ears 32, 33 to fit closely with the exterior of the closure ring 18. When the lugs are fastened to the latter, preferably welded connections 35 extend across the top and bottom edges of the weld lugs as well as along their opposite sides (see FIG. 8).

In addition to the weld lugs described, body portions of lugs 20, 21 have central cylindrical openings passing transversely therethrough as indicated at 40, 41, respectively (see FIGS. 2 and 3). These openings accommodate passage of tie bolt 23 whereby the two lugs maybe drawn toward one another to close ring 18.

It is important to note that the opening 40 in lug 20 preferably is smooth bored and of a diameter to permit free passage of the tie bolt therethrough. On the other hand the opening in lug 21 preferably is internally threaded to present mating threads 46 to the exterior threads 47 of the tie bolt. Thus appropriate thread advancing rotation of the bolt 20 serves to tighten the ring 18 about the lip 16 of the drum cover and compress seal 14 against the drum rim 13.

Figure 7:
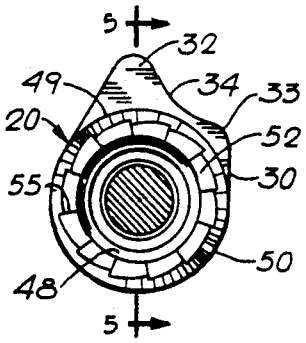
FIG. 7 is a side elevational view of the right hand side of the locking lug shown in FIGS. 3 and 4, taken substantially along vantage line 7—7 of FIG. 1 and looking in the direction of the arrows thereon.
Figure 5:
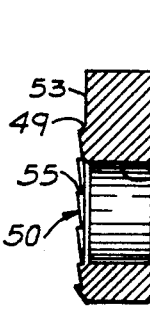
FIG. 5 is a cross sectional view taken substantially along vantage line 5—5 of FIG. 7 and looking in the direction of the arrows thereon.
Figure 6:
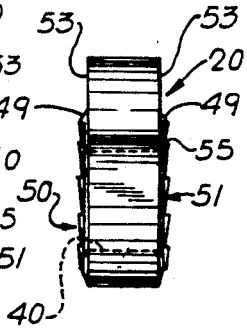
FIG. 6 is a front elevational view of the locking lug shown in FIGS. 3 and 4.
Figure 4:
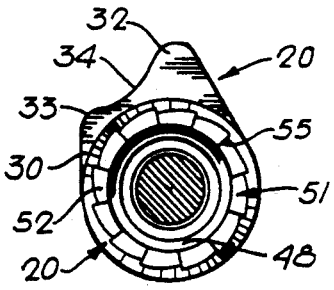
FIG. 4 is a left side elevational view of the left hand locking lug shown in FIGS. 1, taken substantially along vantage line 4—4 of FIG. 1 and looking in the direction of the arrows thereon.
Figure 8:
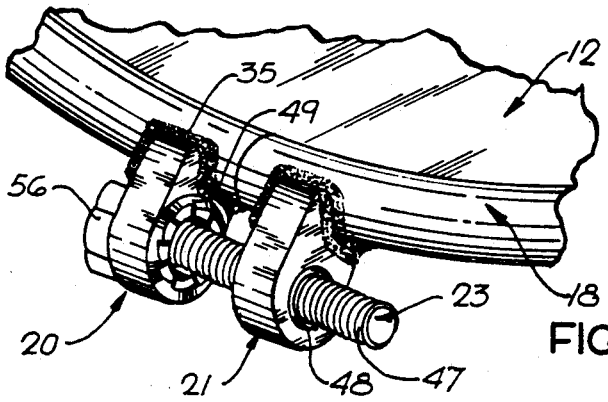
FIG. 8 is a partial perspective view of the drum and closure assembly shown in FIG. 1.

To assist bolt entry and guide the tie bolt into the lug openings, the outer ends of openings 40 and 41 are suitably chamfered inwardly as indicated at 48 in FIGS. 4, 5 and 8. In addition it will be noted that the lateral side faces of the non-threaded lug 20 are formed with raised or axially outwardly extending annular shoulder 49 which border the bolt passage opening 40. The outer faces of these shoulder formations are distinguished by a plurality of novel radially extending teeth or projections 50, 51 (see FIGS. 4 and 7).

Each such projection is formed by a planar arcuately extending surface 52 which extends axially outwardly at an angle to the formational plane of the raised shoulders 49 and planar side walls 53, 53 of the lug 20. Each such arcuate surface 52 terminates at its arcuately outer end in a transversely related surface 54 (see FIGS. 4 and 5) forming thereby a sharp chiseled tooth edge 55 at the intersection of the two surfaces 52 and 54.

Importantly the surfaces 52 are appropriately formed and oriented on both faces of the locking lug 20 to permit passage of the underface of the bolt head 56 thereover to override the sharp edges 55 in response to clockwise or right handed threading movement of the bolt. Conversely, counterclockwise rotation of the bolt, once it is tightened to effect clamping action of the ring 18, is positively resisted by the biting action of the sharp teeth 55 with the bolt head. This relationship holds true for both the left and right hand use positions of the lug 20, as indicated in FIGS. 1 and 8.

It will be appreciated, particularly from FIG. 1 that the lug 20, being provided with locking teeth on opposite or both lateral faces thereof as described, is suited for either left hand insertion of the tie bolt as shown in full lines in FIG. 1 or right hand insertion thereof as shown in phantom in that figure. Consequently, depending on use requirements, the same lug 20 may be used to cover both types of installation thereby effecting marked economies of production inventory and versatility of use. The presence of the locking teeth on the bolt head engaging surfaces of the lug 20 in the closure ring assembly hereof, provides a convenient and operably efficient means for substantially preventing loosening of the installed closure ring assembly. It also will be understood that whether the lugs 20, 21 are forged as integral units as hereinabove described or are fabricated of sheet metal for lighter load application as above alluded to, the presence of anti-rotational locking projections or teeth on at least one of the lugs may be carried out in accordance with the objectives of this invention.

From the foregoing it is believed that those of skill in the art will readily recognize and appreciate the novel advancement presented by this invention and will understand that while the same has herein been described in association with the features of a preferred embodiment thereof illustrated in the accompanying drawings, numerous changes, modifications and substitution of equivalents may be made therein without departing from the spirit and scope of this invention which is intended to be unlimited by the foregoing except as may appear in the following appended claims.

The embodiments of the invention in which an exclusive property or privilege is claimed are defined as follows:

1. A closure assembly for securing a circular cover having an annular peripheral lip over an annular bead rim formed about the open end of a cylindrical storage drum, comprising:

an annular split ring having a transverse contour operable to matingly overfit the annular peripheral lip of the drum cover, a pair of laterally locking lugs extending outwardly from said ring on opposite sides of the split therein;

each of said lugs comprising a generally cylindrical body portion having substantially parallel, lateral faces and a transverse opening therethrough;

a headed tie-bolt having a threaded body portion adapted to be mounted through the openings of said lugs to extend therebetween, thread means associated with one of said lugs for connective engagement with said threaded body portion whereby tightening of said bolt serves to draw the lugs together and thereby contract said ring; and teeth means formed unitarially with the other of said lugs comprising surfaces arcuately extending at a slight angle to the lateral faces of said other of said lugs and surfaces transversely related and extending substantially perpendicularly to said lateral faces of said other of said lugs, said surfaces defining teeth edges at intersections thereof which project outwardly of at least one of said lateral faces of said other of said lugs for frictionally engaging the head of said bolt in a manner permitting threading advancement of said bolt in a tightening direction while substantially resisting dislodgement of said bolt from its tightened position.

2. The combination of claim 1, wherein both lateral faces of said other of said lugs have said teeth means for frictionally engaging the head of said bolt.

3. The combination of claim 1, wherein said thread means are provided within the interior of the opening in said one of said lugs, and the opening in the other of said lugs has a diameter affording free passage of the bolt's body portion therethrough.

4. The combination of claim 1, wherein the lateral faces of said other of said lugs are formed with axially raised annular shoulders about said opening therein, and said teeth means for frictionally engaging the head of said bolt are formed in at least one of said shoulders.

5. The combination of claim 1, wherein said ring is metal, and spaced weld ears extend from the body portion of each of said lugs for welded connection with said ring.

6. In a closure assembly for removably securing a cover over the open end of a cylindrical storage drum by means of a cover engaging split metal ring equipped with a pair of laterally spaced lugs which are interjoined by a threaded tie bolt operable to draw the lugs together and thereby contract the ring; and improved bolt locking lug comprising a generally cylindrical body portion having spaced weld ears for securing the lug to the ring; said body portion having a central axial opening freely receptive of the tie bolt; a pair of raised annular shoulders formed on generally parallel lateral faces of said body portion to border the opposite ends of said opening, and plural raised projections formed on at least one of said shoulders for engaging the head of the tie bolt; said projections being formed and arranged to permit said head to override said projections when said bolt is threadingly advanced thereagainst while materially engaging and resisting reverse movement of said bolt.

7. The combination of claim 6, wherein plural said projections are formed on both of said shoulders.

* * * * *

UNITED STATES PATENT AND TRADEMARK OFFICE

CERTIFICATE OF CORRECTION

PATENT NO. : 5,215,206

DATED : June 1, 1993

INVENTOR(S) : Allen D. Siblik

It is certified that error appears in the above-identified patent and that said Letters Patent is hereby corrected as shown below:

Col. 5, line 1, after "laterally" insert -- spaced --;

Col. 6, line 17, delete second occurrence of "and" and insert -- an --.

Signed and Sealed this

Eighth Day of February, 1994

Bruce Lehman

*Attest:*

BRUCE LEHMAN

*Attesting Officer*

*Commissioner of Patents and Trademarks*